US008210763B2

(12) United States Patent
Gueret

(10) Patent No.: US 8,210,763 B2
(45) Date of Patent: Jul. 3, 2012

(54) APPLICATOR FOR APPLYING A COSMETIC PRODUCT TO KERATINOUS MATERIAL

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 1137 days.

(21) Appl. No.: 12/003,328

(22) Filed: Dec. 21, 2007

(65) Prior Publication Data

US 2009/0214284 A1 Aug. 27, 2009

Related U.S. Application Data

(60) Provisional application No. 60/883,232, filed on Jan. 3, 2007.

(30) Foreign Application Priority Data

Dec. 21, 2006 (FR) ..... 06 55840

(51) Int. Cl.
*A46B 11/00* (2006.01)

(52) U.S. Cl. ..... 401/129; 401/126; 15/204

(58) Field of Classification Search ..... 401/126–130; 15/204, 205, 187, 188; 132/317
See application file for complete search history.

(56) References Cited

U.S. PATENT DOCUMENTS

| | | | | |
|---|---|---|---|---|
| 1,153,118 | A * | 9/1915 | Kimes | 15/204 |
| 1,300,012 | A * | 4/1919 | Purdy | 15/204 |
| 3,921,650 | A | 11/1975 | Montgomery | |
| 4,498,490 | A * | 2/1985 | Seidler | 132/218 |
| 4,545,393 | A | 10/1985 | Gueret et al. | |
| 6,309,125 | B1 | 10/2001 | Peters | |
| 6,331,085 | B1 * | 12/2001 | Schrepf et al. | 401/128 |
| 7,429,141 | B2 | 9/2008 | Habatjou | |
| 7,467,905 | B2 * | 12/2008 | Habatjou | 401/127 |
| 2006/0042647 | A1 | 3/2006 | Vogel | |
| 2007/0020027 | A1 | 1/2007 | Gueret | |
| 2007/0172302 | A1 | 7/2007 | Milesi et al. | |

FOREIGN PATENT DOCUMENTS

| | | |
|---|---|---|
| EP | 1 475 013 | 10/2004 |
| EP | 1 570 763 | 9/2005 |
| EP | 1 726 235 | 11/2006 |
| FR | 2 506 581 | 12/1982 |
| FR | 2 895 218 | 6/2007 |
| GB | 2 074 443 | 11/1981 |

OTHER PUBLICATIONS

European Search Report for EP 07 12 2332, dated May 6, 2008.
French Search Report for FR 06/55840, dated Aug. 14, 2007.

* cited by examiner

*Primary Examiner* — David Walczak
(74) *Attorney, Agent, or Firm* — Connolly Bove Lodge & Hutz LLP

(57) ABSTRACT

An applicator for applying a product to keratinous material, may include a rod and an application member fixed to one end of the rod. The application member may include a core extending from the rod and being fixed relative to the rod. The application member also may include an outer casing including a fixation zone and an application zone. The outer casing may define an inner cavity in which the core is located, and the outer casing may be fixed to one end of the rod at the fixation zone. The outer casing may be free relative to the core, at least over part of the application zone. In addition, the fixation zone of the outer casing may be fixed to the rod and to the core between portions of the rod and the core.

44 Claims, 4 Drawing Sheets

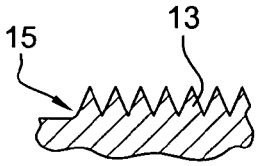
Fig. 19
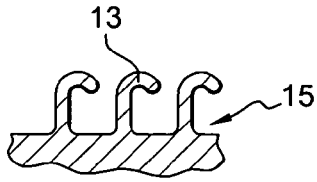
Fig. 20
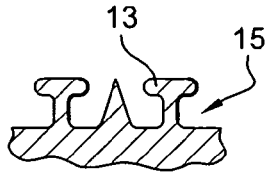
Fig. 21
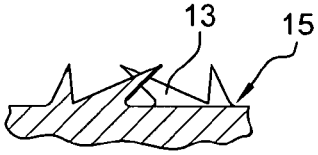
Fig. 22
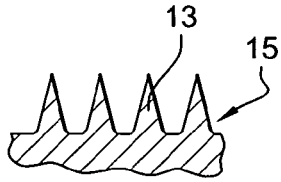
Fig. 23
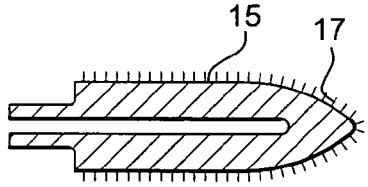
Fig. 24
Fig. 31
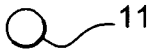
Fig. 32
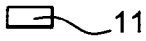
Fig. 33
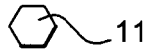
Fig. 34
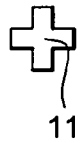
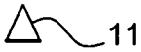
Fig. 35
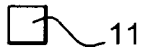
Fig. 36
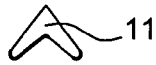
Fig. 37
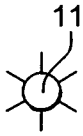
Fig. 38
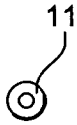
Fig. 39
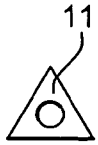
Fig. 40
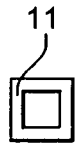
Fig. 41

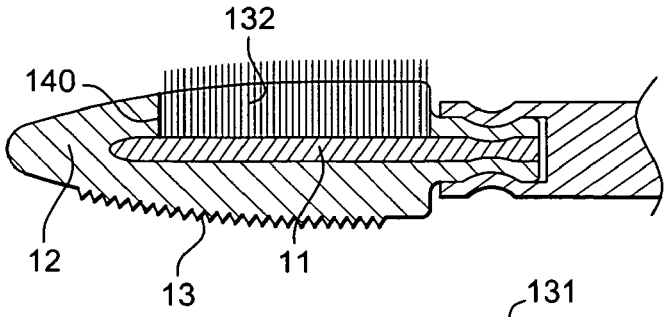
Fig. 25
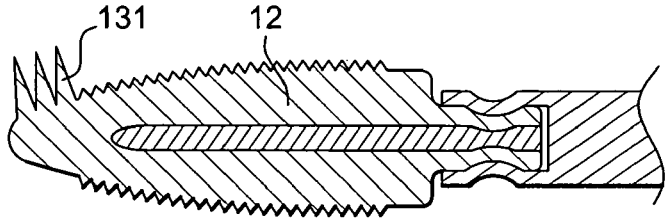
Fig. 26
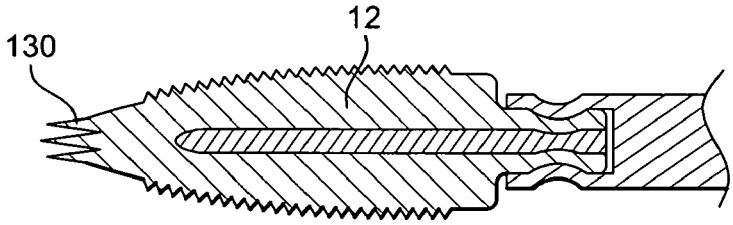
Fig. 27
Fig. 28
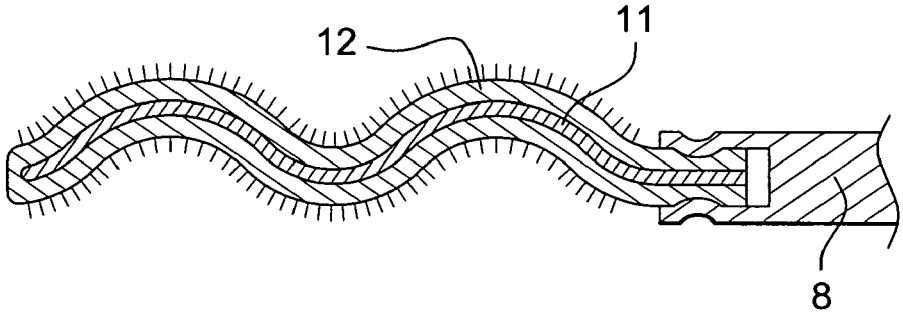
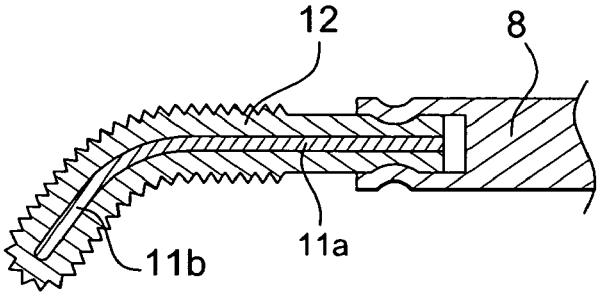
Fig. 29
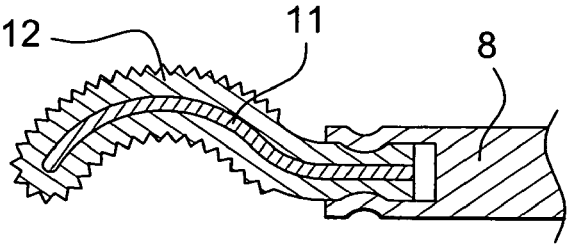
Fig. 30

APPLICATOR FOR APPLYING A COSMETIC PRODUCT TO KERATINOUS MATERIAL

This application claims benefit of U.S. Provisional Application No. 60/883,232, filed Jan. 3, 2007, the contents of which are incorporated herein by reference. This application also claims benefit of priority under 35 U.S.C. §119 to French Patent Application No. FR 0655840, filed Dec. 21, 2006, the contents of which are also incorporated herein by reference.

The present disclosure relates to applicators for applying a product to keratinous material and, more particularly, to applicators for applying a cosmetic care or makeup product, for example a mascara.

Patent applications EP 1 351 592 and EP 1 384 417 disclose brushes comprising a rigid body overmolded with an application surface made of more flexible material and equipped with application elements in the form of barbs. The body comprises relief elements which allow the more flexible part to be retained on the rigid body. Patent application US 2005/0172439 likewise discloses a brush, comprising a hollow rigid portion inside which a more flexible material is injected. The hollow portion further comprises radial orifices through which the soft material is able to emerge in order to form application elements in the form of barbs.

In the foregoing two types of brushes, the resulting application elements are flexible, since they are made of soft material. However, because the application elements are held at their base on a rigid part, they are greatly stressed when they pass, for example, through a wiper, or when they are applied to the eyelashes. If the material used is very soft, the application elements may be deformed as they pass through the wiper. Furthermore, given that the application elements recline when they pass through the wiper, they are wiped to a great extent, so that the product load remaining on the wiped application elements is affected.

Document FR 2 506 581 describes a mascara brush comprising a tubular sleeve and a central rod which passes through the sleeve and is able to slide within it so as to vary the length of the application portion of the brush. The rod protrudes beyond the sleeve at an application end in such a way as to receive an elastomer sleeve tube serving for application of the product. The sleeve tube is retained at the distal end of the rod by a portion of the rod shaped as a rivet head. In another embodiment, a bellows which serves for application of the product is snap-fastened to the end of the sleeve. When the rod is slid in the sleeve, the sleeve tube or bellows undergoes deformation so as to vary the application length.

Document EP 1 475 013 describes a mascara brush comprising a rod. Fixed to the end of the rod is a twisted core which carries bristles over part of its circumference. A sleeve tube comprising teeth is shrunk around the bristled core so that the teeth extend in the portion of the circumference that does not contain bristles.

Document US 2006/0042647 describes a sleeve tube which carries bristles and is attached to a central core which in turn is fixed to the end of a rod.

There is a need to produce an applicator which does not have the drawbacks of the prior art. There is also a need to produce an applicator which is very gentle in application. There is likewise a need to produce an applicator which is simple to manufacture.

This disclosure is directed to meeting at least one or more of these needs.

In the following description, certain aspects and embodiments of the present invention will become evident. It should be understood that the invention, in its broadest sense, could be practiced without having one or more features of these aspects and embodiments. In other words, these aspects and embodiments are merely exemplary.

In one aspect, the disclosure provides an applicator for applying a product to keratinous material. The applicator may include a rod, and an application member fixed to one end of the rod. The application member may include a core extending from the rod (e.g., as a projection of the rod), the core being fixed relative to the rod (e.g., secured to the rod or made monolithically with the rod). The application member also may include an outer casing including a fixation zone and an application zone, the outer casing defining an inner cavity in which the core is located (e.g., inserted). The outer casing may be fixed to one end of the rod at the fixation zone and may be free relative to the core, at least over part of the application zone (e.g., some or all of the application zone of the outer casing may be free relative to the core). The fixation zone of the outer casing may fixed to the rod and to the core between portions of the rod and the core (the outer case may be fixed to the rod and to the core so as to be sandwiched between the rod and the core).

For purposes of this disclosure, the phrase "at least part of the application zone of the casing is free relative to the core" is defined to mean that some or all of the application zone is not fixed or immovable relative to the core. A spacing, even a very small spacing, may separate this part of the casing from the core. This may allow this part of the casing to move, even substantially, relative to the core when its outer surface is stressed, for example stressed manually. This part of the casing may, for example, be stretched, or may rotate about the core. In at least some embodiments, when the product is applied to the keratinous material, or in the course of passage through a wiper, if the outer surface of the casing is stretched in one direction, its base, since it is not fixed to the core, also may be able to stretch substantially in the same direction. As a result, the outer surface may not be excessively deformed.

In at least some embodiments, a configuration of this kind may allow the use of a very soft, very flexible material for making the casing, without any risk that it will be impaired when it is stressed mechanically. Thus, an applicator may be obtained which allows a very high degree of gentleness in application. For example, when the applicator has surface application elements, these application elements may have a very high degree of flexibility.

For at least some embodiments, the casing being located (e.g., sandwiched) between the rod and the core may allow the casing to be properly immobilized. This may be advantageous when the casing is made of a soft, flexible material, in which case the casing may be difficult to immobilize.

The fixation zone of the outer casing may, for example, be fixed to the rod by hot or cold crimping. The core may also be fixed to the end of the rod by crimping, for example, at the same level as the casing and during the same crimping operation. In this way, the applicator may easily be made industrially.

The casing may be closed at its end opposite the fixation zone, so as to surround the core entirely, the core not being accessible from the outside. The rod may include a main part and an intermediate portion on which the application member is fixed, the intermediate portion being fixed to the remainder of the rod by snap fastening, screwing, adhesive bonding, forced insertion or crimping. The intermediate portion carrying the application member may thus be mounted removably or permanently on the rod.

The casing may be an individually molded component, for example, without the core. It may be made, for example, of a material from the following list: elastomer, for example thermoplastic elastomer, LDPE, PVC, PU, thermoplastic polyester elastomer, EPDM, PDM, EVA, SIS, SEBS, SBS, latex, silicone, nitrile, butyl, polyurethane, polyether-block-amide, and polyester. It may be made of a single material or, by bi-injection-molding, of two different materials, for example of two different colors.

The core may be made of thermoplastic material selected from the following list: HDPE, LDPE, linear PE, PP, PT, POM, PA, PET. and PBT. The core also may be made of metal.

The core may be stiffer than the casing of the application member. This may result in an applicator which is sufficiently stiff to allow effective application on the area to be treated, due to the presence of the rigid core, while ensuring gentle application, due to the casing of more flexible material which comes into contact with the area to be treated.

The casing may define an application surface which may include application elements, in the form of bristles or teeth, in such a way as to form an applicator for the eyelashes. The application elements may be arranged in the form of one or more rows extending along the casing. The casing may define an application surface which may be at least partly covered by a flock coating, formed, for example, of a blend of at least two different fibers.

The outer casing may include teeth, at its end opposite the fixation zone. The teeth may be arranged substantially parallel to an end portion of the core. In a variant, the outer casing may include teeth in proximity to its end opposite the fixation zone, and arranged in such a way as to form a comb off-centered relative to the core.

The cross section of the casing may have a general form selected from the following list: circular, polygonal, for example triangular, square, pentagonal or hexagonal, and oblong, for example lenticular-oval. The casing may have a cylindrical general form. The surface of the casing defining the cavity may be smooth.

The rod may extend along a longitudinal axis and the core may extend along another longitudinal axis. The longitudinal axes of the rod and of the core may be coaxial. In a variant, the longitudinal axis of the rod may form a non-zero angle with the longitudinal axis of at least part of the core. The angle may be, for example between 0° and 30°, between 1° and 20°, or between 2° and 10°.

The core may be curved over at least part of its length. The core may define a center of symmetry for at least one cross section of the outer casing. In a variant, the core may be off-centered within a cross section of the casing at least at one point of the length of the application member. The cross section of the core may have a general form selected from the following list: circular, polygonal, for example triangular, square, pentagonal or hexagonal, oblong, for example lenticular-oval, cruciform, V-shaped, or C-shaped. The core may have a solid or hollow cross section.

In some embodiments, the core may be twisted. Bristles may be captured in the core. In that case the casing may include at least one opening, for example a slot, through which the bristles extend. The applicator may in that case include bristles on one side and application elements in the form of teeth, for example, formed on the surface of the casing, over its remainder. In a variant, bristles and teeth may be alternated over the circumference of the casing. In some embodiments, the casing and/or the core may be magnetizable.

The rod may extend from (e.g., be joined to) a grip member equipped so as to tightly close a vessel containing the product to be applied. The rod may include a flexible portion which is able to flex during use. The flexible portion may be situated between a part of the rod that serves for the joining of the core, and a part of the rod that is connected to the grip member. The flexible portion may, for example, be formed by die shaping of the rod and/or by a thinned-down portion of the rod and/or by a portion made of more flexible material than the remainder of the rod.

Some aspects include a device for accommodating and applying a cosmetic product to be applied to keratinous material, comprising any of the applicators described herein, and a vessel containing the cosmetic product to be applied. The vessel may include a wiper of any type, for example a flexible or rigid wiper made of foam or including a lip.

The disclosure additionally provides, in another of its aspects, a method of manufacturing any of the applicators as described herein, including molding the casing comprising a fixation zone and an application zone and defining an internal cavity. The method also includes attaching the casing to the core, locating (e.g., inserting) the fixation zone of the casing in, on, or otherwise against the rod, and crimping the end of the rod on the casing, or on the casing and on the core.

The applicator according to the disclosure may be used in order to apply a cosmetic product to the eyes, for example to the eyelashes or eyebrows, to the lips, nails, or eyelids, or to any other part of the body, or to the hair.

Aside from the structural arrangements set forth above, the invention could include a number of other arrangements such as those explained hereinafter. It is to be understood that both the foregoing description and the following description are exemplary only.

The disclosure may be better understood from a reading of the detailed description which follows, and of non-limiting examples of its implementation, and from an examination of the attached drawing, in which:

FIG. 1, schematically and partially, shows in axial section an example of an accommodation and application device in accordance with the disclosure;

FIG. 2, in isolation and partially, diagrammatically shows in axial section the applicator of the device of FIG. 1;

FIGS. 3 and 4 illustrate embodiments of the applicator, including the fixing of the application member to the rod;

FIGS. 5 to 10, in longitudinal section, illustrate different forms of the casing of the application member;

FIGS. 11 to 18, in transverse section, illustrate different forms of the application member;

FIGS. 19 to 23 illustrate examples of application elements with different forms;

FIG. 24 illustrates an example of an application member including a flocked application surface;

FIGS. 25 to 27 illustrate different configurations of application elements;

Figure 42:
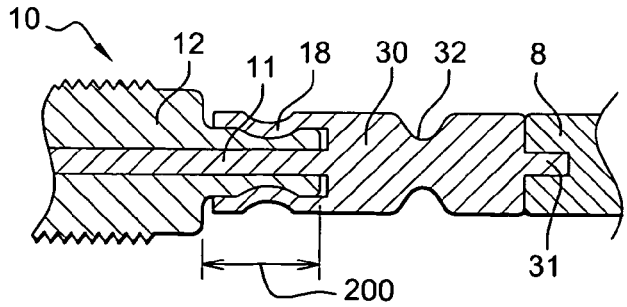

FIGS. 28 to 30, in longitudinal section, illustrate different forms of the application member;

FIGS. 31 to 41 illustrate various examples of cross sections of the core of the application member; and FIG. 42 illustrates one embodiment of the applicator.

Figure 1:
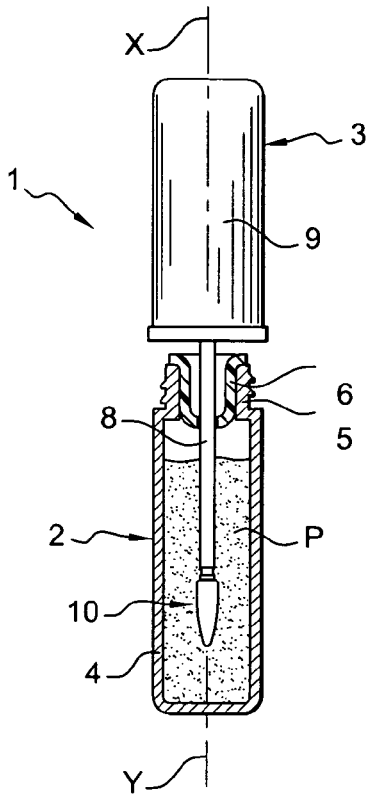

The accommodation and application device 1 shown in FIG. 1 includes a vessel 2 containing a product P to be applied to the eyelashes and/or the eyebrows. For example, the product may be a makeup product, such as mascara, or a care product. The accommodation and application device 1 may also include an applicator 3 for taking up the product P and applying it.

The vessel 2 may include a body 4 equipped with a neck 5 which, in the example of FIG. 1, houses a wiper member 6. The applicator 3 includes a rod 8, with a longitudinal axis X, which may join at one end to a grip member 9 that likewise may constitutes a sealing cap of the vessel 2.

In the example illustrated, the rod 8 is cylindrical, with a constant diameter. However, it is not outside the scope of the disclosure for the rod 8 to include a necked-in portion. The necked-in portion may be situated at the level of the wiper member 6, for example at a lip of the member 6, so as not to deform the rod during storage when the vessel 2 is closed. At its other end the rod 8 carries an application member 10, which has been represented in isolation in FIG. 2, and which will be described below.

Figure 2:
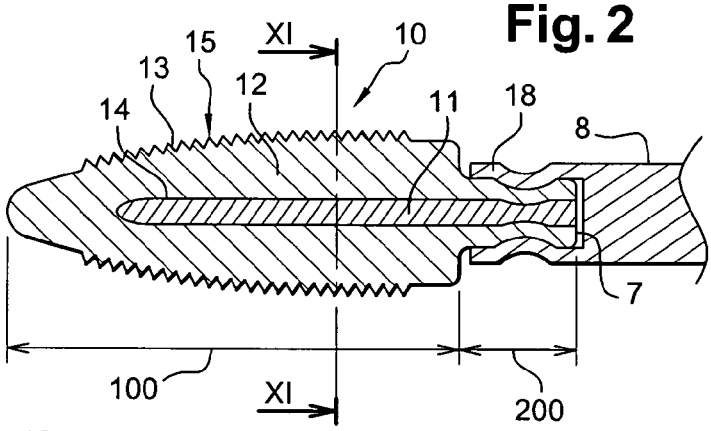

In the example of FIG. 2, the rod 8 may be made of a single piece. In a variant, however, as has been shown in FIG. 3, it is possible to envisage an intermediate rod portion 16 carrying the application member 10. The intermediate portion 16 may be, for example, fixed by screwing to the remainder of the rod 8. In a variant, this intermediate portion could be fixed in any other way to the rod, for example, by snap fastening, adhesive bonding, forced insertion, or by crimping. This intermediate portion may therefore be mounted on the remainder of the rod, either removably or definitively.

As illustrated in FIG. 42, the rod 8 may include a portion 30 of increased flexibility, which is able to flex when the brush is brought into contact with the eyelashes and/or when the applicator passes through the wiper member 6 while being withdrawn from the vessel 2. The zone of increased flexibility 30 may be formed, for example, by die shaping of the rod and/or by a thinned-down portion thereof and/or by a portion made of material which is more flexible than the remainder of the rod. According to the example illustrated in FIG. 42, the flexible portion 30 includes a zone of lower thickness 32, and may be forcibly inserted into a housing 31 of the rod 8.

The wiper member 6 may be, for example, configured to wipe the rod 8 and the application member 10. Depending on the form of the application member 10 and the material from which it is made, and also on the form and the nature of the wiper member 6, the application member 10 may or may not deform on passing through the wiper member 6. The wiper member 6 may be selected, for example, according to the amount of product it is desired to retain on the application member 10 after its emergence from the vessel 2.

Both the application member 10 and the wiper member 6 may undergo deformation when the applicator 3 is withdrawn, for example. The wiper member 6 may be of any type and may, for example, include a flexible lip which, at its lower end, defines a circular orifice with a diameter substantially equal to that of the rod 8. In a variant, the wiper orifice may have a diameter which is different from that of the rod 8 and/or may have a non-circular form. The wiper member 6 may be made of a plastic, for example of PE, PP, POM, PET, nitrile, silicone, EPDM, SIS, or SEBS, a thermoplastic polyester elastomer such as that, for example, known under the brand name Hytrel®, or a thermoplastic elastomer such as that, for example, known under the name Santoprene®. This list is by way of example, and is not limiting.

The wiper member 6 may also not be linked to the neck, but instead molded or overmolded on the neck. The wiper member may also include an opening of variable diameter in order to vary its passage cross section for the application member, and/or to vary its deformability. The wiper member 6 may include a wavy wiper lip which is able to spread out in response to the passage of the application member. The wiper member may also be different and may take the form of a foam block.

Referring now to FIG. 2, it can be seen that the rod 8 includes a housing 7 at its end which carries the application member 10, the application member 10 being fixed in the housing 7. The fixing of the application member to the rod will be detailed later in the description.

The application member 10 includes a central portion 11 forming a relatively rigid core, and an outer casing 12 which surrounds the core and which carries application elements 13 in the form of bristles or teeth. The casing may be made of a more flexible material than the core, so as to give a soft and flexible brush which is very gentle in application.

The casing may be made, for example, of elastomer, for example thermoplastic elastomer, LDPE, PVC, PU, thermoplastic polyester elastomer, EPDM, PDM, EVA, SIS, SEBS, SBS, latex, silicone, nitrile, butyl, polyurethane, polyether-block-amide, or polyester.

The casing 12 includes an application zone 100 which carries the application elements 13 on its outer surface, and a fixation zone 200 at one end, which serves to fix the application member to the rod. In the example illustrated, the fixation zone 200 has a reduced diameter relative to the major part of the application zone 100, so as to be inserted in the housing 7 of the rod 8.

Figure 11:
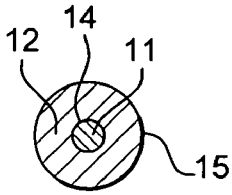

The casing defines an internal cavity 14 in which the core is inserted. The cavity 14 may be elongated and may extend from the fixation zone 200, where it is open, to the other end of the casing, where it does not open out. In the example illustrated in FIG. 2, the cavity 14 has a circular cross section, as can be seen in FIG. 11. However, it is not outside the scope of the disclosure to use a cavity having any other cross section. The cross section of the cavity may be polygonal, for example triangular, square, pentagonal, or hexagonal, or oblong, for example lenticular-oval In the example illustrated in FIGS. 1 and 2, the cavity 14 has a constant cross section over its whole length. However, it is also possible to make a casing 12 having a cavity 14 with a cross section which varies along its length, as is the case, for example, in FIG. 8. In the example of FIGS. 2 and 11, the cavity 14 is centered within a cross section of the casing, in such a way as to define a center of symmetry of this section. In a variant, the cavity may be off-centered within a cross section of the casing at least at one point of the length of the application member, as has been illustrated in FIGS. 9 and 15 to 18. In the example illustrated, the surface of the casing defining the cavity 14 is smooth.

Figure 5:
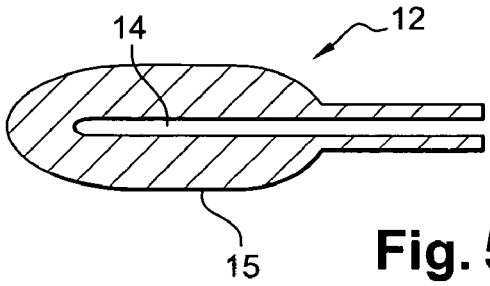
Figure 6:
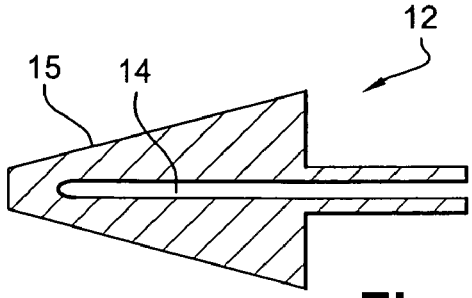
Figure 7:
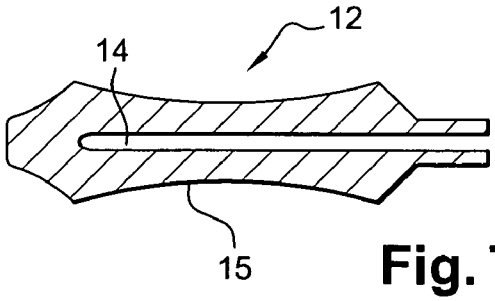
Figure 10:
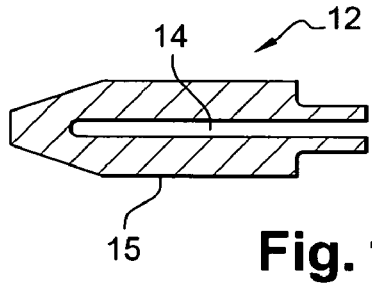

In the example illustrated in FIG. 2, the application zone 100 of the casing 12 defines an outer surface of rotationally cylindrical general form. In a variant, the application zone 100 of the casing may have an oval form as in FIG. 5, a frustoconical form as in FIG. 6, or may include a rotationally cylindrical portion and a frustoconical part as illustrated in FIG. 10. The application zone 100 of the casing may also define a surface which is concave towards the outside, as illustrated in FIG. 7.

Figure 12:
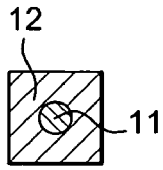
Figure 13:
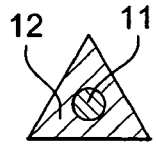
Figure 14:
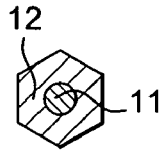
Figure 15:
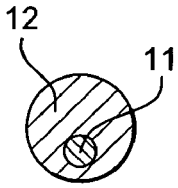
Figure 16:
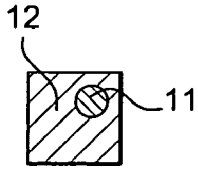
Figure 17:
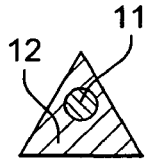
Figure 18:
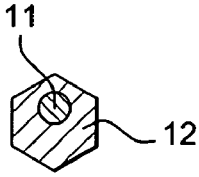

The application zone 100 of the casing may have a circular cross section, as is seen in FIG. 11, a polygonal, for example triangular, cross section, as in FIG. 13, a square cross section, as shown in FIG. 12, a pentagonal or hexagonal cross section, as in FIG. 14, or an oblong cross section, for example a lenticular-oval cross section.

Figure 8:
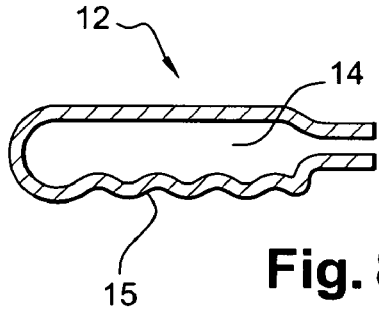
Figure 9:
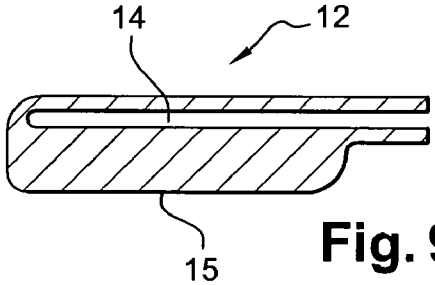

The application zone 100 of the casing may further include profiles which are different on either side of a median plane of the application member, as in the example of FIG. 8. The zone may or may not be symmetrical relative to the median plane.

The application zone 100 of the casing defines an application surface 15 on the outside. The application surface 15 may include application elements 13 which are distributed in the form of one or more identical or different rows. The rows extend along the casing, for example.

FIGS. 19 to 23 show different forms of application elements 13 formed on the application surface 15.

The application elements 13 may have any form. They may be in the form of triangular teeth with bases which are connecting, as seen in FIG. 19, or they may be spaced apart, as in FIG. 23. Two adjacent teeth may form a V-shape as seen in FIG. 22. The teeth may be incurved with a curvilinear longitudinal axis, as illustrated in FIG. 20. The teeth may form a bulb at their end, as seen in FIG. 21. FIG. 21 also shows that a row of teeth may include an alternation of teeth of different forms.

Where appropriate, the application member may, after molding, undergo an operation of mechanical treatment of the application elements, for example a grinding action, where appropriate, in contact with a hot or cold surface. Examples of treatment methods for teeth are described in patent applications FR 2 852 500 and FR 2 850 549.

The application elements 13 may also be covered with a flock coating. The flock coating may include fibers which are all identical, or it may include a blend of different fibers.

The application surface 15 may also be devoid of application elements, and may be smooth. It may also be covered with a flock coating 17 as illustrated in FIG. 24.

The application surface 15 may likewise define a screw thread over its entire length.

Application elements in the form of teeth may also be arranged on the outside of the casing 12 opposite the fixation zone, the teeth being arranged substantially parallel to an end portion of the core. Three teeth 130 are, for example, arranged at the tip of the application member, as illustrated in FIG. 27. In a variant, the outer casing 12 may also include teeth, in proximity to its end opposite the fixation zone, which may be arranged in such a way as to form a miniature comb 131 off-centered relative to the core, as seen in FIG. 26.

In order to stiffen the application member 10, a core 11 is provided inside the cavity 14 of the casing.

The core may be rigid so as to endow the applicator with the strength necessary to apply the product to the eyelashes. It may be flexible in such a way as to endow flexibility in application. It may be made of a deformable material with shape memory, or without shape memory, so as to allow particular applicator forms to be obtained, as will be described below.

The core 11 may be formed, for example, by an elongated metallic element, for example an iron wire, or by an elongated plastic element. The core may be produced, for example, of a thermoplastic material selected from the following list: HDPE, LDPE, linear PE, PP, PT, POM, PA, PET, and PBT.

In the example illustrated in FIG. 2, the core is straight and extends along an axis Y which is coincident with the axis X of the rod. The core has a length of 27 mm, for example.

It is not outside the scope of the present disclosure to use a curved core 11 having a single curve, as seen in FIG. 30, or a wavy core as shown in FIG. 28. The core 11 may also have a straight portion and a curved portion.

In a variant, the core 11 may also include two straight portions, 11*a* and 11*b*, which form an angle between them, as seen in FIG. 29. The portion 11*a* of the core adjacent to the rod may have a longitudinal axis which is coincident with the longitudinal axis of the rod. The distal portion 11*b* of the core may form an angle with the rod.

The core may also include a first portion with a longitudinal axis which is coincident with the longitudinal axis of the rod which extends within it, and a second portion, situated outside the rod, which forms a non-zero angle with the first portion.

As is seen in FIGS. 11 and 31, the core additionally may have a circular cross section, with a diameter of 1 mm, for example. The diameter of the core may be substantially equal to that of the cavity 14 of the casing. It may also be substantially larger or smaller than that of the cavity 14 of the casing.

The core may also have a cross section of any other form, as shown in FIGS. 32 to 38, for example a rectangular, hexagonal, cruciform, triangular, square, V-shaped or circular cross section, with radial projections as seen in FIG. 38. The core may be solid or hollow in cross section, as illustrated in FIGS. 39 to 41, in order to endow it with flexibility.

Figure 4:
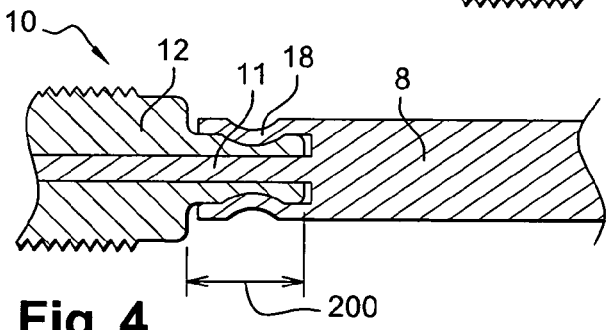

In the example illustrated in FIGS. 1 and 2, the core is a separate piece arranged in the projection of the rod. In a variant, it is possible to use a core 11 which is made in a single piece with the rod 8, as illustrated in FIG. 4.

In a variant which is illustrated in FIG. 25, the core 11 may be twisted, being made, for example, of two twisted metallic strands. Bristles 132 may be captive in the twisted core. In that case the casing 12 may include at least one opening, for example a slot 140, through which the bristles extend. The applicator may then include bristles 132 on one side and application elements in the form of teeth 13, for example, formed on the surface of the casing, over the remainder thereof. Bristles and teeth may, in a variant, alternate over the circumference of the casing.

In the example of FIG. 2, the core extends in all of the cavity 14 of the casing. The fixation zone 200 of the casing, in which a portion of the core extends, is inserted in the housing 7 of the rod 8. The portion 18 of the rod that surrounds the housing 7 is crimped on the fixation zone 200 of the casing, which in turn is crimped on the core. It is crimped, for example, at two diametrically opposed points. In a variant, it could be crimped at a single point or at more than two points, or alternatively over the whole circumference.

The casing 12 is therefore fixed to the core 11, solely in the fixation zone 200, at its end. In contrast, the casing 12 is free relative to the core 11 over all of the application zone 100. In other words, the casing 12 is not fixed or attached to the core in the application zone. This allows this part of the casing to move, even substantially so, relative to the core when it is stressed on its outer surface, for example stressed manually. It may, for example, rotate relative to the core, so as to curl on the core. It may also stretch along the longitudinal axis of the core. This makes it possible to reduce the stresses which are applied to the application surface 15 of the casing, and to the application elements 13, when application is made to the eyelashes, for example, or when the applicator passes through the wiper 6.

In order to produce the applicator of FIG. 2, the casing 12 may be produced by molding. The casing is attached to the core 11 by the open part of the cavity 14, the core being housed within this cavity. When the diameter of the cavity 14 is equal to or substantially less than the diameter of the core, it is possible to envisage expanding the casing before attaching it to the core, so as to make this step easier. It is possible, for example, to inflate the casing or to stretch it by vacuum in the course of automated mounting of the casing on the core.

The fixation zone 200 of the application member 10 may be subsequently inserted in the housing 7 of the rod, the core being free relative to the casing over all of the application zone 100. Subsequently the end of the rod, surrounding the housing 7, may be crimped on the fixation zone 200 of the casing, which in turn is crimped on the core. This crimping step may be carried out with or without heating, for example. In this way, the casing 12 may contract onto the core, over the fixation zone 200, so as to be retained on the core.

The flexible casing 12, accordingly, is sandwiched between the rigid rod 8 and the rigid core 11. In this way the application member 10 is retained very effectively on the rod.

Figure 3:
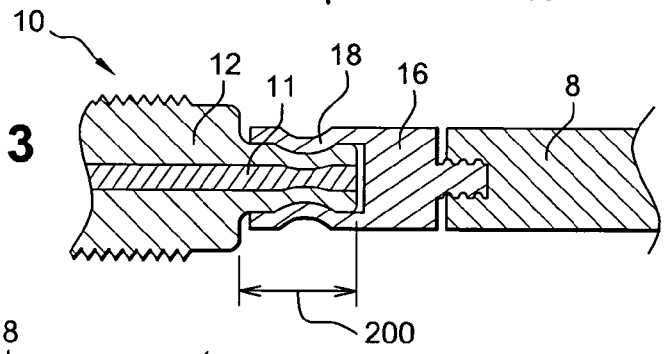

When the rod 8 includes an intermediate portion 16 as illustrated in FIG. 3, the fixation zone 200 of the casing may be inserted in the housing 7 provided in the intermediate portion 16 of the rod.

In the variant illustrated in FIG. 4, the portion 18 of the rod 8 surrounding the housing 7 may be crimped on the fixation zone 200 of the casing, without the casing being crimped in turn on the core 11, since the core in the embodiment of FIG. 4 is made in a single piece with the rod 8.

When the core 11 is curved, or when it includes a portion forming an angle with another portion, as in the embodiments illustrated in FIGS. 28 to 30, the core may be inserted in the casing 12 while being straight, the casing also being initially straight. After the core has been inserted in the cavity 14, it may be deformed, either hot, or mechanically without heating, depending on the material used for the core and for the casing, in order to obtain its ultimate form. In this case a shape-memory material will be selected, for example a stainless steel core. Because the casing is flexible, it then follows the change of form of the core.

It would also be possible for deformation to be carried out by the user, prior to use, who may beforehand have purchased an applicator having a straight core.

In the detailed description above, reference has been made to exemplary embodiments. It is obvious that variants can be made to these embodiments without departing from the present disclosure. For example, when the vessel includes a wiper member through which the application member is withdrawn, the application member may or may not be subjected to vibrations as it passes through the wiper member. This may allow the application member to be wiped differently when subjected to vibration than in the absence of vibration of the application member. The user may thus, for example, select from at least two degrees of wiping of the application member, depending on whether the application member vibrates, or does not vibrate, as it passes through the wiper member.

The product may also be applied by means of a product application aid device. This device may include removable structure for fixing to at least one finger, hand, or wrist, or for being held in the hand, and may include a vibrating source which allows vibrations to be produced.

The core and/or the casing of the application member may be magnetizable.

It will be apparent to those skilled in the art that various modifications and variations can be made to the structure described herein. Thus, it should be understood that the invention is not limited to the subject matter discussed in the specification. Rather, the present invention is intended to cover modifications and variations.

What is claimed is:

1. An applicator for applying a product to keratinous material, comprising:

a rod; and an application member fixed to one end of the rod, the application member including:

a core extending from the rod, the core being fixed relative to the rod; and an outer casing including a fixation zone and an application zone;

wherein the outer casing defines an inner cavity in which the core is located;

wherein the outer casing is fixed to one end of the rod at the fixation zone;

wherein the outer casing is closed at an end of the outer casing opposite the fixation zone;

wherein the outer casing is free relative to the core, at least over part of the application zone; and wherein the fixation zone of the outer casing is fixed to the rod and to the core between portions of the rod and the core.

2. An application according to claim 1, wherein the core is fixed relative to the rod by being made monolithically with the rod.

3. An applicator according to claim 1, wherein all of the application zone of the outer casing is free relative to the core.

4. An applicator according to claim 1, wherein the fixation zone of the outer casing is fixed to the rod by crimping.

5. An applicator according to claim 1, wherein the core is fixed to the end of the rod by crimping.

6. An applicator according to claim 1, wherein the rod includes a main part and an intermediate portion on which the application member is fixed, the intermediate portion being fixed to the main part of the rod by at least one of snap fastening, screwing, adhesive bonding, forced insertion, or crimping.

7. An applicator according to claim 1, the casing including a material selected from at least one of an elastomer, thermoplastic elastomer, LDPE, PVC, PU, thermoplastic polyester elastomer, EPDM, PDM, EVA, SIS, SEBS, SBS, latex, silicone, nitrile, butyl, polyurethane, polyether-block-amide, and polyester.

8. An applicator according to claim 1, wherein the casing is an individually molded component.

9. An applicator according to claim 1, wherein the core is made of thermoplastic material selected from at least one of HDPE, LDPE, linear PE, PP, PT, POM, PA, PET, and PBT.

10. An applicator according to claim 1, wherein the core is made of metal.

11. An applicator according to claim 10, wherein the application elements are one of bristles and teeth.

12. An applicator according to claim 1, wherein the core is stiffer than the casing of the application member.

13. An applicator according to claim 1, wherein the outer casing defines an application surface and includes application elements.

14. An applicator according to claim 13, wherein the application elements are arranged in the form of one or more rows extending along the casing.

15. An applicator according to claim 1, wherein the outer casing defines an application surface which is at least partly covered by a flock coating.

16. An applicator according to claim 15, wherein the flock coating includes a blend of at least two differing fibers.

17. An applicator according to claim 1, wherein the outer casing includes, at its end opposite the fixation zone, teeth which are arranged substantially parallel to an end portion of the core.

18. An applicator according to claim 1, wherein the outer casing includes teeth, the teeth being in proximity to an end of the outer casing opposite the fixation zone and being arranged so as to form a comb off-centered relative to the core.

19. An applicator according to claim 1, wherein the cross section of the outer casing has a general form selected from circular, polygonal, square, pentagonal, hexagonal, oblong, and lenticular-oval.

20. An applicator according to claim 1, wherein the casing has a cylindrical general form.

21. An applicator according to claim 1, wherein the surface of the casing defining the inner cavity is smooth.

22. An applicator according to claim 1, wherein the rod extends along a longitudinal axis and the core extends along a longitudinal axis, the longitudinal axis of the rod and being coaxial with the longitudinal axis of the core.

23. An applicator according to claim 1, wherein the rod extends along a longitudinal axis and the core extends along a longitudinal axis, the longitudinal axis of the rod forming a non-zero angle with the longitudinal axis of at least part of the core.

24. An applicator according to claim 23, wherein the non-zero angle is between 0° and 30°.

25. An applicator according to claim 24, wherein the non-zero angle is between 1° and 20°.

26. An applicator according to claim 24, wherein the non-zero angle is between 2° and 10°.

27. An applicator according to claim 1, wherein the core is curved over at least part of its length.

28. An applicator according to claim 1, wherein the core defines a center of symmetry for at least one cross section of the outer casing.

29. An applicator according to claim 1, wherein the core is off-centered within a cross section of the casing at least at one point along the length of the application member.

30. An applicator according to claim 1, wherein the cross section of the core has a general form selected from circular, polygonal, triangular, square, pentagonal, hexagonal, oblong, lenticular-oval, cruciform, V-shaped, and C-shaped.

31. An applicator according to claim 1, wherein the core has a hollow section.

32. An applicator according to claim 1, wherein the core is twisted.

33. An applicator according to claim 32, wherein bristles are captured in the core.

34. An applicator according to claim 33, wherein the casing includes at least one opening through which the bristles extend.

35. An applicator according to claim 34, wherein the opening is a slot.

36. An applicator according to claim 1, wherein at least one of the casing and the core is magnetizable.

37. An applicator according to claim 1, wherein the rod extends from a grip member configured to tightly close a vessel containing the product to be applied.

38. A device for accommodating and applying a cosmetic product to be applied to keratinous materials, comprising an applicator according to claim 1, and a vessel containing the cosmetic product to be applied.

39. A device according to claim 38, wherein the vessel includes a flexible or rigid wiper.

40. A device according to claim 39, wherein the product comprises one of a care product and a makeup product.

41. A device according to claim 40, wherein the product is a mascara.

42. A method of manufacturing an applicator, the applicator including a rod and an application member fixed to one end of the rod, the application member including a core extending from the rod, the core being fixed relative to the rod, and an outer casing including a fixation zone and an application zone, the casing defining an inner cavity in which the core is located, the outer casing being fixed to one end of the rod at the fixation zone and being free relative to the core, at least over part of the application zone, the fixation zone of the outer casing being fixed to the rod and to the core between portions of the rod and the core, the method comprising:

molding the casing including the fixation zone and the application zone and defining the inner cavity;

attaching the casing to the core;

locating the fixation zone of the casing against the rod; and crimping the end of the rod on the fixation zone of the casing.

43. A method according to claim 42, including crimping the fixation zone of the casing on the core.

44. An applicator according to claim 1, wherein the core extends substantially along the length of the outer casing.

* * * * *